US006698805B2

(12) United States Patent
Erices et al.

(10) Patent No.: US 6,698,805 B2
(45) Date of Patent: Mar. 2, 2004

(54) MOTOR VEHICLE ELECTRIC DOOR LOCK

(75) Inventors: Bernardo Erices, Berg.gladbach (DE); Simon Brose, Hattingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/032,705

(22) Filed: Jan. 2, 2002

(65) Prior Publication Data

US 2002/0167177 A1 Nov. 14, 2002

(30) Foreign Application Priority Data

Jan. 2, 2001 (DE) ..... 101 00 008

(51) Int. Cl.[7] ..... E05C 3/06

(52) U.S. Cl. ..... 292/216; 292/201; 292/DIG. 23

(58) Field of Search ..... 292/216, 215, 292/201, 197, DIG. 23

(56) References Cited

U.S. PATENT DOCUMENTS

| | | | | | |
|---|---|---|---|---|---|
| 3,620,560 | A | * | 11/1971 | Peters | 292/201 |
| 3,785,186 | A | * | 1/1974 | James et al. | 70/240 |
| 4,363,231 | A | * | 12/1982 | Kaveney, Jr. | 70/484 |
| 4,904,006 | A | * | 2/1990 | Hayakawa et al. | 292/336.3 |
| 5,000,495 | A | * | 3/1991 | Wolfgang et al. | 292/216 |
| 5,020,838 | A | * | 6/1991 | Fukumoto | 292/201 |
| 5,066,054 | A | * | 11/1991 | Ingenhoven | 292/201 |
| 5,172,946 | A | * | 12/1992 | Dowling | 292/216 |
| 5,308,128 | A | * | 5/1994 | Portelli et al. | 292/216 |
| 5,308,129 | A | * | 5/1994 | Hlavaty | 292/216 |
| 5,348,357 | A | * | 9/1994 | Konchan et al. | 292/216 |
| 5,632,515 | A | * | 5/1997 | Dowling | 292/216 |
| 5,802,894 | A | * | 9/1998 | Jahrsetz et al. | 70/264 |
| 5,847,519 | A | * | 12/1998 | Kilker | 318/14 |
| 5,901,991 | A | * | 5/1999 | Hugel et al. | 292/201 |
| 5,934,717 | A | * | 8/1999 | Wirths et al. | 292/201 |
| 6,003,910 | A | * | 12/1999 | Dupont et al. | 292/201 |
| 6,050,117 | A | * | 4/2000 | Weyerstall | 70/277 |
| 6,076,868 | A | * | 6/2000 | Roger et al. | 292/201 |
| 6,109,674 | A | * | 8/2000 | Bartel et al. | 292/337 |
| 6,232,684 | B1 | * | 5/2001 | Haag et al. | 310/68 R |
| 6,349,983 | B1 | * | 2/2002 | Dupont et al. | 292/201 |

(List continued on next page.)

FOREIGN PATENT DOCUMENTS

| | | | | |
|---|---|---|---|---|
| DE | 1 678 024 | | 8/1971 | |
| DE | 41 19 703 | C1 | 10/1992 | |
| DE | 41 17 110 | C1 | 12/1992 | |
| DE | 195 45 722 | A1 | 4/1997 | |
| DE | 196 19 958 | A1 | 11/1997 | |
| DE | 196 24 640 | C1 | 1/1998 | |
| DE | 197 10 531 | A1 | 9/1998 | |
| DE | 199 02 561 | A1 | 8/2000 | |
| EP | 0 589 158 | A1 | 3/1994 | |
| FR | 2775016 | A1 * | 8/1999 | ..... E05B/65/12 |
| GB | 1 413 887 | | 11/1975 | |

*Primary Examiner*—William Miller
*Assistant Examiner*—Thomas Ho
(74) *Attorney, Agent, or Firm*—Nixon Peabody LLP; David S. Safran

(57) ABSTRACT

A motor vehicle electric door lock with an outside housing which is essentially closed on all sides, with an inlet channel for a key collar and located in the outside housing, a rotary latch, a detent pawl which holds the rotary latch, a separate detent pawl lever which is dynamically connected to the detent pawl or which is made on the detent pawl as an extension, and an electrical opening drive unit with a drive motor, step-down gearing, and a driven element, the driven element via the detent pawl lever driving the detent pawl in the lifting direction and engaging the actuating section of the detent pawl lever. The drive unit is located in the drive housing which is located in the outside housing and which is sealed relative to the remainder of the outside housing, the driven element of the drive unit is a cam wheel which is located on the outside of the drive housing and the drive shaft of the cam wheel is sealed by a rotary bushing which is routed through the wall of the drive housing.

7 Claims, 4 Drawing Sheets

U.S. PATENT DOCUMENTS 6,371,536 B1 * 4/2002 Koerwer et al. ..... 292/201
6,375,234 B1 * 4/2002 Brackmann et al. ..... 292/1
6,386,599 B1 * 5/2002 Chevalier ..... 292/201
6,390,517 B1 * 5/2002 Ehret ..... 292/201
6,419,286 B1 * 7/2002 Szablewski ..... 292/216
6,422,616 B1 * 7/2002 Wortmann et al. ..... 292/216
6,428,058 B1 * 8/2002 Graute ..... 292/216
6,435,573 B1 * 8/2002 Szablewski ..... 292/201
6,439,623 B1 * 8/2002 Lohfeld et al. ..... 292/201
6,463,773 B1 * 10/2002 Dimig ..... 70/277
6,471,259 B1 * 10/2002 Weyerstall et al. ..... 292/201
2001/0010427 A1 * 8/2001 Martin ..... 292/201
2001/0050483 A1 * 12/2001 Hanisch et al. ..... 292/216
2001/0052705 A1 * 12/2001 Fisher ..... 292/216
2002/0074808 A1 * 6/2002 Inoue ..... 292/216

* cited by examiner

MOTOR VEHICLE ELECTRIC DOOR LOCK

BACKGROUND OF THE INVENTION

1. Technical Field of the Invention

The present invention relates to a motor vehicle door lock, more particularly to an electric side door lock of a motor vehicle body.

2. Description of the Prior Art

A motor vehicle door lock in the form of an electric lock has long been known as disclosed in DE 195 45 722 A1.

In accordance with the present invention it should be considered that in the terminology a "motor vehicle door lock" is defined particularly as side door locks of motor vehicle bodies, but may also include door locks for rear doors or rear hatches, for sliding doors and hoods, to the extent they are provided with an electric motorized opening aid. The expression motor vehicle door lock or the expression electric lock is used below representatively for the different types of door locks.

Further, in accordance with the present invention the key collar is defined as a wedge-shaped clamp in a narrow sense, but may also include locking clips, locking clips with a transversely lying locking pin and free-standing locking pin, as well as all other types of counterpieces to the door lock on the opposing body component.

An inlet channel for the key collar is made in the housing of the motor vehicle door lock, often also in an additional mounting part which is located in the housing and which is generally called a catch bearing. The inlet channel is completed by the corresponding inlet slots in metal reinforcing plates on the front and/or back of the outside housing; they are often also called the first and the second rear sheet.

Rotary latches and detent pawls are typical lock elements of one such motor vehicle door lock, the rotary latch currently being made mostly as a fork latch with a preliminary catch and a main catch. The rotary latch and the detent pawl include ordinary additional parts such as the detent pawl spring and the rotary latch springs, as are of course known from the prior art. Motor vehicle door locks are also known with simply one locking catch, which replaces the rotary latch and the detent pawl, and these motor vehicle door locks also lie within the framework of this invention.

The blocking elements, bearing bolts for the blocking elements and the rear sheets generally consist of metal in order to be able to accommodate and deflect the tearing forces which occur in practice, especially in an accident. The outside housing, other mounting components and the catch bearing of a motor vehicle door lock currently consist mostly of plastic, often fiber-reinforced plastic. To some extent also metal inserts and metal parts are additionally used.

An electric lock is characterized by a minimum number of installation parts because the sole control function is lifting the detent pawl off the rotary latch. All other functions which are accomplished in mechanical door locks by lever arrangements are replaced in an electric lock by switching functions of the electronic circuit or the software by which the drive motor is triggered or not triggered.

The known electric lock disclosed in DE 195 45 722 A1 shows an outside housing which is essentially closed on all sides and which is made as a plastic molding. It is disclosed there that the outside housing according to one preferred development is made essentially symmetrical to its center plane which lies in or parallel to the plane of the rotary latch and detent pawl and consists of two half shells which are made of plastic, are provided on the outside with metallic reinforcing plates, and are connected to one another. This outside housing is made elongated and plate-like and on the two flat sides parallel to the center plane is provided in the half facing the lengthwise end with an inlet slot, the two inlet slots jointly forming the through inlet channel. The inlet channel with the inlet slots on the two flat sides of the outside housing is the catch bearing of the key collar.

The above explained construction of the known electric lock allows easy installation for both left-hand entry and right-hand entry of the key collar or also for middle entry of the key collar for example on a rear door or rear hatch. The flat and slender contour of the outside housing is also suited for limited installation space.

The above noted electric lock is disclosed on the one hand as a pure electric lock, in which redundancy is achieved by electrical means, for example by an extra battery or other additional power supply as disclosed in EP 0 589 158 A1, but can also be additionally equipped with auxiliary mechanical actuation of the detent pawl via Bowden cables. Reference should be made to these publications for the various possibilities of the configuration of auxiliary mechanical actuation.

In accordance with the present invention, there is no auxiliary mechanical actuation; it is intended to be primarily a pure electric lock with optionally electrically implemented redundancy. In any case auxiliary mechanical actuation accomplished as in the prior art is not entirely precluded, in particular does not contradict the implementation of the present invention.

In the above explained prior art, it has already been recognized that the concept of an electric lock offers a high level of antitheft protection, because even after forcible entry into the motor vehicle the door locks cannot be unlocked since the microswitches on the inside door handles have been deactivated via the control electronics. Due to the extensive encapsulation of the rotary latch and the detent pawl which is implemented in this motor vehicle door lock with the electric drive unit in the closed outside housing, it is not possible to act mechanically on the detent pawl either. It has, however, been recognized that the inlet slot theoretically offers a point of potential penetration. To this extent a special antitheft measure has been proposed such that in the outside housing there is an antitheft lever which blocks the detent pawl in the engaged position in a down position and which is pretensioned in the direction of the lifting position. This antitheft lever is activated by the electrical drive unit in the "antitheft" operating position of the electric lock.

In the above explained prior art, the electric drive unit has a drive motor, step-down gearing and a driven element. In this embodiment there is an electric drive motor which interacts via toothed gearing with a threaded spindle and a threaded rod in order to actuate the detent pawl. In another embodiment, the electric drive motor interacts with a worm gear pair with a worm gear as the driven element which has an eccentrically arranged arc-shaped crank of a certain contour which, upon actuation of the electric drive motor is caused to rotate and strikes the driver arm of the detent pawl lever which for its part lifts the detent pawl. The driver arm of the detent pawl lever is made so long that the crank can start in both directions of rotation. In one direction of rotation it acts with a low step-down ratio on the detent pawl so that the detent pawl is quickly lifted, in the opposite direction of rotation it acts with a much greater step-down ratio on the detent pawl lever and thus on the detent pawl so that an increased breakaway moment is available and opens the electric lock even with a high door counterpressure.

A corresponding drive unit of a motor vehicle door lock which operates likewise in two directions of rotation is disclosed in DE 197 10 531 A1, on the cam wheel which is used as the driven element there are two individual cams or journals which are offset by 180° against one another in order to keep the starting times of the drive as short as possible.

Electric drive units are also known which work in only one direction of rotation, even if optionally reset by reversing under spring force, however, such devices have a degressive starting characteristic, therefore when starting they would first apply a high moment which as the lifting motion of the detent pawl continues is reduced incrementally or continuously as set forth in DE 41 19 703 C1.

In the above explained known electric lock, on the outside on the outside housing there is an electric terminal for the electrical terminals of the drive unit and the microswitches which are necessary for operation and which are located in the outside housing. For the microswitches which are designed to detect the position of the detent pawl and rotary latch and other operating states, electromechanical microswitches are typical, but at present so are also proximity switches, especially Hall switches. Reference is made to DE 195 45 722 A1. Contact can be made via a board or printed circuits which are cast into the plastic material of the outside housing. In this connection it is known that the drive motor of the electrical drive unit can be mechanically fixed and at the same time electrically connected by slipping it onto the terminal lugs of the circuit board.

Finally, the prior art discloses, particularly when using a worm gear pair as the step-down gearing with a cam wheel as the driven element, controlling the shutoff of the electric drive motor by a cam, journal or crank of the cam wheel striking a block via torque consumption, current consumption or a timer. Alternatively of course conventional switch controls with plug braking of the electric drive motor are known for these purposes.

The above explained motor vehicle door lock which provides a basis upon which the present invention evolves has a plastic outside housing which is essentially closed to the outside, with an interior largely protected against the entry of moisture. In this prior art; however, it has already been recognized that the inlet channel of the key collar remains as an entry area for moisture, therefore, this area must be sealed with measures known from the prior art, if this is considered necessary. Within the outside housing there is however the electrical drive unit with the corresponding circuit components so that in fact sealing of the inlet channel is necessary.

If the inlet channel for the key collar in practice cannot be optimally sealed, which will most often be the case, placing the electric drive unit in its own, separate sealed drive housing which is assembled with the outside housing can also be considered. This is known for a rear hatch lock as disclosed in DE 196 19 958 A1. In the electric lock disclosed therein the plastic, essentially closed drive housing contains an electric drive motor with step-down gearing and a cam wheel with two journal-shaped cams as the driven element. The drive housing is located side by side with the outside housing of the motor vehicle door lock, the outside housing containing only the rotary latch, the detent pawl and the detent pawl lever formed as an elongated arm of the detent pawl integrally therewith. The outside housing is not sealed. By way of an edge-side slot in the outside housing which is congruent with the corresponding slot in the drive housing, the detent pawl lever enters the drive housing from the outside housing and extends over to the cam wheel. On this end the detent pawl lever has a fork-shaped recess into which the respective cam of the cam wheel can fit.

The above described construction has sealing disadvantages due to the arrangement of the lengthwise slots.

Finally, a motor vehicle door lock, made with an outside housing which is not fully closed, but has a plurality of openings via which moisture can enter is known. This outside housing contains the rotary latch and the detent pawl as well as a plurality of levers of the lock mechanism. The outside housing bears the rotary latch and the detent pawl on one side of a center wall, held there by the rear sheet with the lever of the lock mechanism on the other side of the center wall. Ultimately the outside housing is reduced here to the peripheral edge of a plastic catch bearing.

A plastic housing cover in which the electrical conductors are injected is connected to the peripheral edge of the outside housing in the above noted motor vehicle door lock. The housing cover has a trough-shaped receiver open to the inside for the electrical drive unit which is sealed shut by a closing plate. On the inside the closing plate bears the electrical drive motor and the step-down gearing. The driven element of the step-down gearing is made as a cam wheel and is located on the opposing side, thus the outside of the closing plate. This cam wheel projects into the lock mechanism at suitable locations as soon as the housing cover has been joined to the edge of the outside housing. The cam wheel is sealed by the closing plate by way of a rotary bushing so that the receiver of the electrical drive unit is extremely well protected against moisture.

The above explained motor vehicle door lock is not an electric lock, but a mechanical motor vehicle door lock provided with an electrical central interlock system in which the electrical drive unit is best sealed against moisture by encapsulation of all components with an electrical function in a plastic housing cover.

SUMMARY OF THE INVENTION

Proceeding from the initially explained prior art detailed above, an object of the present invention is to optimize the known electric lock while maintaining the three-dimensionally optimum configuration of the outside housing both in the outside contour and in the interior.

Initially, the aforementioned object is achieved by way of an electric lock wherein the electric drive unit is located in an essentially closed drive housing which is sealed relative to the remainder of the outside housing and which itself is again located in the outside housing itself. For the electric drive unit therefore a housing in a housing is implemented, so that the drive housing itself in terms of sealing technology need simply manage the "residual moisture" which has not already been kept out by the essentially closed outside housing. Viewed in this way, the drive housing implemented in accordance with the present invention itself is not in direct contact with the ambient atmosphere.

The sealing of the electrical drive unit is further optimized by the drive shaft of the cam wheel being sealed by way of a rotary bushing being routed through the wall of the drive housing and the cam wheel being located on the outside of the housing. Even in the implementation of the cam wheel as a driven element of the electric drive unit, in the past the exit from the closed drive housing had always been assigned to the translationally displaced detent pawl lever. In an electrical opening drive unit, as is implemented in an electric lock in accordance with the present invention, the implementation of a rotary bushing can ultimately be sealed much better than a bushing in which a level moves back and forth. This rotary bushing with its better sealing capacity advantageously optimizes the overall sealing of the electrical drive unit of the electric lock in accordance with the present invention.

According to a further object of the present invention, optimum blocking of the detent pawl lever which is in the closed position can be achieved. The antitheft feature of the detent pawl was heretofore explained in accordance with the aforementioned prior art devices. This required an additional antitheft lever moved by the electric drive motor. This lever blocks the detent pawl in the closed position only in the "antitheft" operating position, therefore with the vehicle stopped and locked from the outside.

In accordance with the present invention, the implementation of a pure electric lock with simply electrically implemented redundancy enables direct blocking of the detent pawl lever in the closed position by means of the driven element of the electric drive unit. With a drive unit designed to be self-locking, with the drive motor turned off the driven element cannot be pressed back mechanically on the part of the detent pawl lever. But it can be left blocking in front of the detent pawl lever. Since there is no emergency opening by hand, the detent pawl lever can be blocked in this way, thereby greatly simplifying this operation. This in turn leads to the fact that there need be no additional elements within the outside housing, the external shape of the outside housing and its internal configuration can remain essentially unchanged.

Accordingly, blocking of the detent pawl lever and thus of the detent pawl is achieved in a side impact. Complex measures are carried out for blocking of the detent pawl against unintentional lifting caused by acceleration forces, as implemented in DE 196 24 640 C1; GB 1 413 887 B; DE 41 17 110 C; DE 1 678 024 C. The same effect is achieved in the motor vehicle door lock of the present invention entirely without these complex measures, because the detent pawl is always blocked by the driven element even in the closed position and thus even with a side impact. The safety engineering aspect of emergency opening is satisfied in the electric lock in accordance with the present invention optionally via electrical redundancy.

The motor vehicle door lock set forth in accordance with the present invention can be especially feasibly installed based on its fundamental structural concept; it is possible to install the entire electric lock from only one direction, so that rotation of the workpiece during installation, as is necessary in all existing constructions, can be omitted. This special installation procedure and the particular construction of the motor vehicle door lock in accordance with the present invention in this respect are the subject matter of a parallel application filed substantially at the same time as the present application having U.S. application Ser. No. 10/032,695.

The invention is detailed below using drawings which show only one embodiment.

BRIEF DESCRIPTION OF THE DRAWINGS

FIG. 3 illustrates the cam wheel and the detent pawl lever of the electric lock extracted of FIG. 1 while

DETAILED DESCRIPTION OF THE INVENTION

Figure 1:
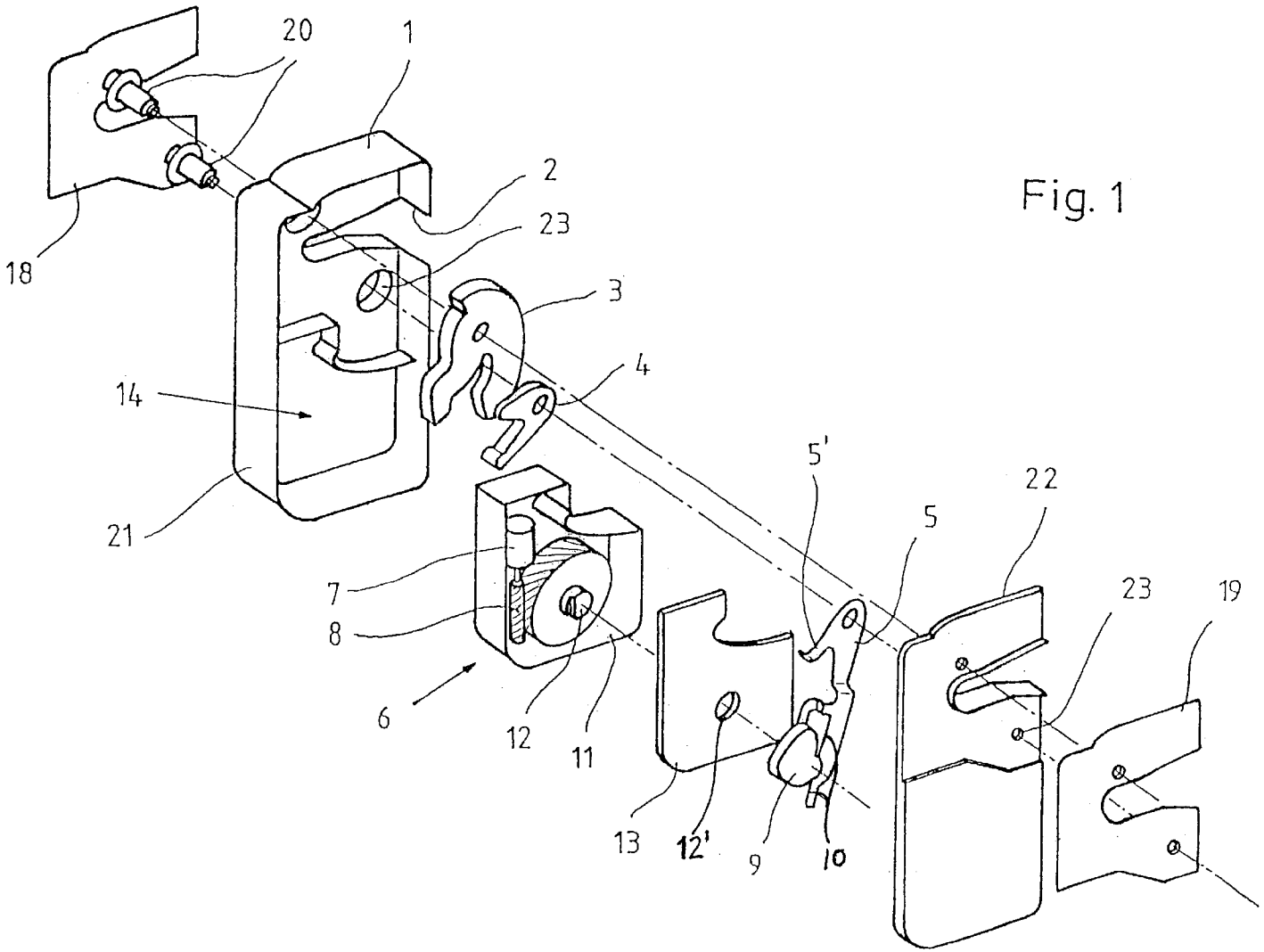
FIG. 1 shows in a type of exploded view the structure of one especially preferred embodiment of a motor vehicle door lock in accordance with the present invention which is made as an electric lock, at the same time showing the installation sequence according to the preferred embodiment.

Initially, reference should be made to the introductory part of the description for the explanation of the various terms in this application. The term electric lock is also used below for the motor vehicle door lock in accordance with the present invention. Furthermore, for comprehensive disclosure of a plurality of construction versions for an electric lock, reference should be made to DE 195 45 722 A1 which forms the base point for the present invention, and the contents of which are also incorporated herein by reference.

The exploded view of FIG. 1 clearly shows all the features explained below in conjunction with the somewhat enlarged representation in FIG. 2 and in FIG. 3 using the preferred embodiment shown here.

The illustrated electric lock has an outside housing 1 which is essentially closed on all sides and which, as is already known in the prior art, is made as a plastic molding and also as one part of the catch bearing for the key collar which is not shown here, and is used to hold a corresponding key collar buffer.

The outside housing 1 has an inlet channel 2 for the key collar, which, as stated, is not shown, and which is located on the opposite part of the motor vehicle body. In the outside housing 1 of the electric lock there are only the locking elements, specifically the rotary latch 3 and the detent pawl 4 which holds the rotary latch 3 in the closed position, especially in a preliminary catch and in a main catch, a separate detent pawl lever 5 which is dynamically connected to the detent pawl 4 or which is made as an extension of the detent pawl 4, and an electrical opening drive unit 6 with a drive motor 7, step-down gearing 8, and a driven element 9. Other important small parts such as the detent pawl springs, rotary latch springs or combined tension springs, leg springs for pretensioning of the detent pawl lever 5, microswitches or Hall sensors, printed conductors or circuit board, etc. are not shown.

The driven element 9 via the detent pawl lever 5 drives the detent pawl 4 in the lifting direction and engages the actuating section 10 of the detent pawl lever 5 in doing so.

The drive unit 6 is located in a drive housing 11 which is located in the outside housing 1 and which is sealed relative to the remainder of the outside housing 1, the driven element 9 of the drive unit 6 is a cam wheel 9 which is located on the outside of the drive housing 11 and the drive shaft 12 of the cam wheel 9 sealed by means of a rotary bushing 12' is routed through the cover 13 of the drive housing 11. FIG. 2 shows the cam wheel 9, FIG. 1 shows the rotary bushing of the drive shaft 12. The electrical drive unit 6 in this embodiment is made as a worm gear drive. For the configuration of the cam wheel 9 the explanations in the general part of the specification apply which refer to the versions known in the prior art with one or two journal-shaped cams or a crank or even several cranks.

Figure 2:
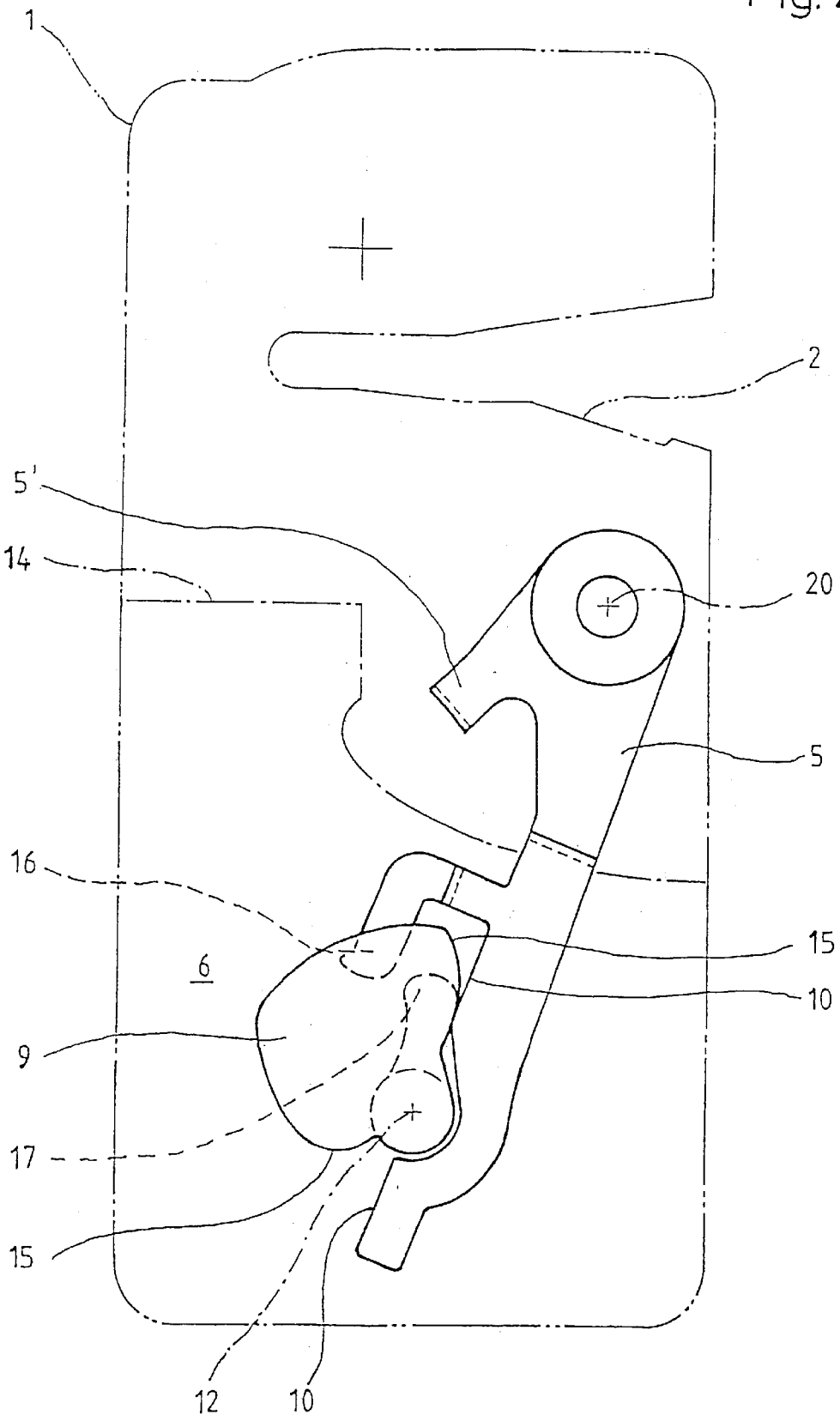
FIG. 2 is a schematic view of the bottom part of the outside housing of the electric lock of FIG. 1, having the cover therefore removed.
Figure 3:
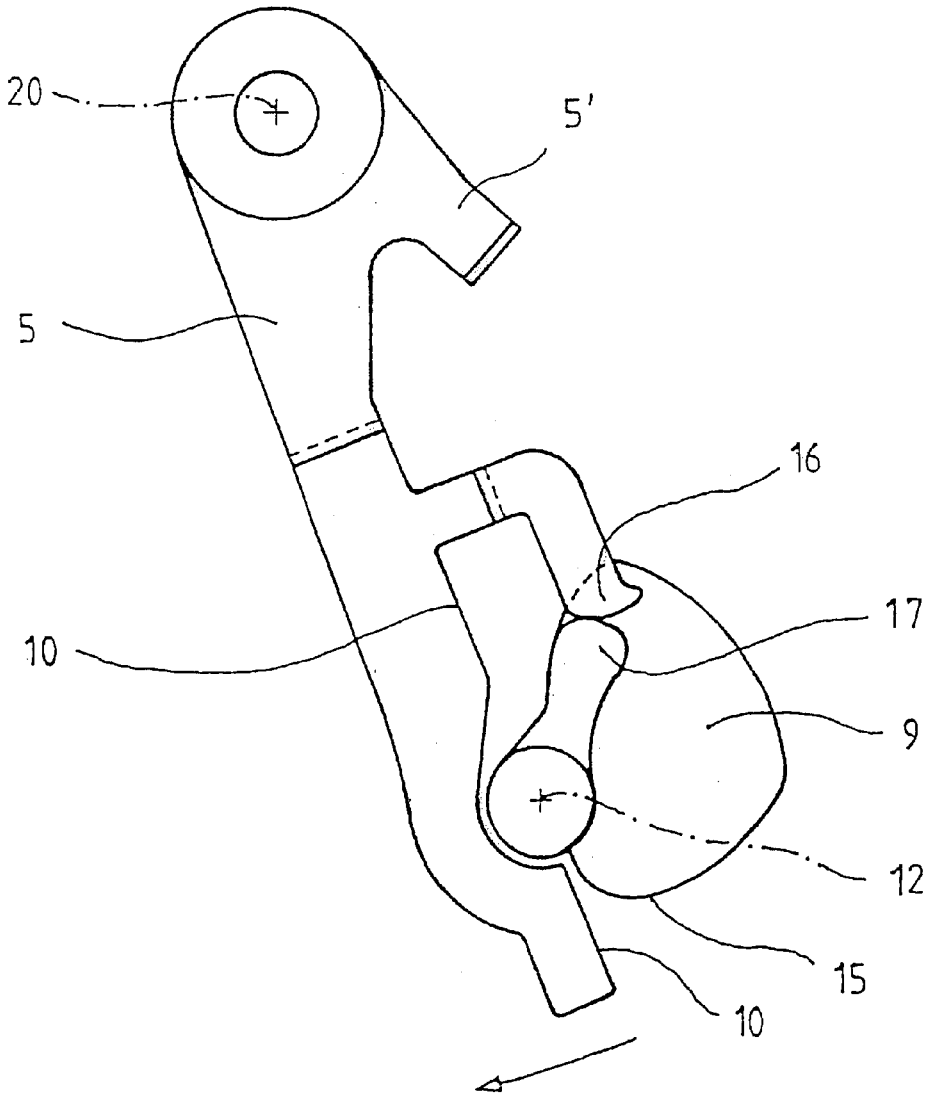

The depicted embodiment shows both in FIG. 2 and FIG. 3 that the outside housing 1 is made elongated and like a flat plate. Here it is provided that the inlet channel 2 with the rotary latch 3 and the detent pawl 4 is located roughly in the half of the outside housing 1 near the lengthwise end and the drive unit 6 is located roughly in the half of the outside housing 1 near the other lengthwise end, and the detent pawl lever 5 extends from the one half into the other. This slender and flat, plate-like construction of the electric lock allows installation even under constricted space conditions and thus represents an especially feasible embodiment of the electric lock.

Furthermore, it is provided here that the inlet channel 2 is open toward the two flat sides of the outside housing 1. Accordingly, the electric lock of the present invention allows for installation in the motor vehicle body independently of the side. Finally, it is provided here that the inlet channel 2 is made as a catch bearing or as part of the catch bearing for the key collar.

The preferred embodiment illustrates in FIG. 1 in conjunction with FIG. 2 that the cam wheel 9 is located on the outside of the wall of the drive housing 11 parallel to the plane defined by the rotary latch 3 and the detent pawl 4. In this way the rotation of the cam wheel 9 takes place in a plane parallel to the motion of the locking elements. This in turn makes it possible to have the detent pawl lever 5 supported and actuated axially parallel to the detent pawl 4. This is an especially simple construction which has proven very effective in practice and in this case contributes to optimum use of space within the outside housing 1. The embodiment shown illustrates that according to one preferred teaching the wall is formed by the cover 13 which is placed on the trough-shaped bottom part of the drive housing 11 to form a seal.

To form the drive housing 11 there are two different possibilities. While not shown, the trough-shaped bottom part of the drive housing 11 may be formed integrally in the outside housing 1 and closed with a separate cover 13 to form a seal. In this version the drive housing 11 is assembled in the outside housing 1; the outside housing 1 forms the drive housing 11 essentially in a sealed "compartment".

As illustrated, the drive housing 11 is made separate, especially with a trough-shaped bottom part and a cover 13 which is seated to form a seal, and is inserted into the outside housing 1, preferably into the receiver 14 of the outside housing 1. FIG. 1 shows the receiver 14 formed by a crosspiece in the outside housing 1, this crosspiece being used at the same time for positioning and fixing the drive housing 11 within the outside housing 1. Accordingly, the electric drive unit 6 can be assembled beforehand as a module and then inserted easily into the outside housing with the drive housing 11 closed.

Part of the electrical drive unit 6 should also be the control electronics which is made or located likewise protected within the drive housing 11. The contact-making possibilities with the circuit board, etc. are discussed hereinabove.

FIGS. 2 and 3 show particulars of the mechanical power transfer from the cam wheel 9 to the detent pawl lever 5. The embodiment shown illustrates the separate detent pawl lever 5 so that the detent pawl 4 can remain lifted, even if the detent pawl lever 5 has already returned again to the closed position shown in FIG. 2.

As illustrated in FIGS. 2 and 3, the cam wheel 9 has an eccentrically arranged, arc-shaped crank 15 which engages the actuating section 10 of the detent pawl lever 5.

The arc-shaped crank 15 can be shaped in its outside contour which engages the actuating section 10 such that a certain motion characteristic of the detent pawl lever 5 with certain moments arises. As noted hereinabove, there are a plurality of stimuli for cam contours in the prior art.

While not specifically illustrated, the drive unit 6 may actuate the detent pawl lever 5 in only one direction of rotation and preferably the cam wheel 9 in interaction with the actuating section 10 accomplishes a degressive starting characteristic. The concept of degressive starting characteristic means that when the starting motion begins, a high moment is applied and is reduced according to the contour of the crank 15 as the rotary motion of the cam wheel 9 continues, to the benefit of low stepping down and thus increased opening speed.

The preferred embodiment shown illustrates one alternative the drive unit 6 actuates the detent pawl lever 5 in both directions of rotation and the cam wheel 9 in one direction of rotation with a low step-down ratio acts on the detent pawl 4, in the other direction of rotation on the other hand on the detent pawl 4 with a larger step-down ratio. In FIG. 2 the direction of rotation of the cam wheel 9 clockwise is the direction of rotation which is first in this sense with a low step-down ratio, but higher speed, the direction of rotation of the cam wheel 9 counterclockwise corresponds to the second direction of rotation with the higher step-down ratio and lower speed. In terms of control engineering of course the torque of the electric drive motor 7 or another characteristic quantity must be acquired in order to establish that it is necessary to switch from one operating mode to the other, for example when an especially high door counterpressure has been set (for example, after an accident). The concept implemented here makes it possible to achieve different speeds and moments with unchanged triggering of the electric drive motor 7, therefore abandoning phase angle control or pulse width modulation.

Otherwise, in terms of circuitry many of the possibilities known from the prior art can be used, especially the rotary latch, detent pawl and/or worm gear of the step-down gearing 8 can be provided with magnets which actuate suitably arranged Hall switches. The drive unit 6 can additionally be equipped via mechanical stops for the step-down gearing 8 for respective calibration when the positioning drifts, as is likewise known from the prior art.

FIGS. 2 and 3 further show one particular feature of the electric lock, that is, the drive unit 6 is designed to be self-locking, that on the especially separate detent pawl lever 5 in the actuation section 10 a shaped blocking piece 16 is formed and when the driven element 9 is in the rest position and when the detent pawl lever 5 is in the closed position the driven element 9 is in front of the shaped blocking piece 16 of the detent pawl lever 5 such that the detent pawl lever 5 cannot swivel in a raising direction (FIG. 3).

To not swivel in the raising direction means in this embodiment in the implementation of a detent pawl lever 5 which is separate from the detent pawl 4, not the blocking of the detent pawl 4, but the blocking of the detent pawl lever 5 such that it cannot be unintentionally swiveled in the raising direction upon a side impact with the action of a force in the swivelling plane of the detent pawl lever 5. FIG. 3 shows the raising direction by the arrow. Motion in this direction is prevented by the shaped blocking piece 16.

In a detent pawl lever 5 made on the detent pawl 4 integrally as an elongated arm, blocking of course also results in that the detent pawl 4 cannot be mechanically pressed up from the inlet channel 2 (additional antitheft feature).

Figure 4:
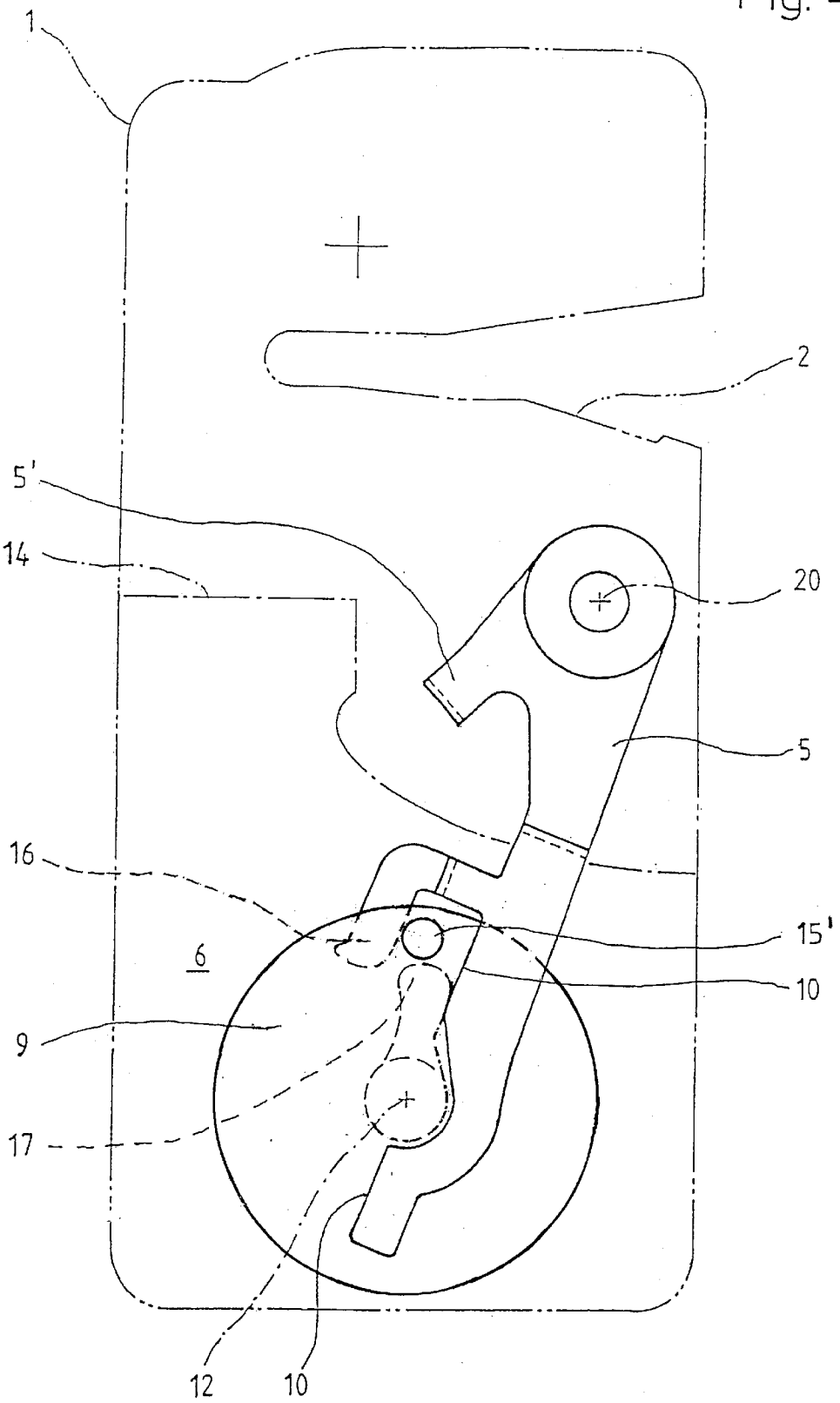
FIG. 4 shows a portion of the cam wheel having a journal for engaging an actuating portion of the detent pawl and is interacting with a shaped blocking piece.

The embodiment shown illustrates that the driven element is a cam wheel 9 which has at least one journal or a crank 15 as shown. At this point it can be provided that the journal, another journal 15' (FIG. 4), or especially the existing crank 15 interacts with the shaped blocking piece 16 on the detent pawl lever 5.

The preferred embodiment shown however illustrates one version in which the crank 15 in both directions of rotation interacts with the actuating section 10 of the detent pawl lever 5. Consequently it is provided here in an especially suitable manner that the other flat side of the cam wheel 9 is used for the blocking function. To do this a blocking projection 17 is formed on the surface of the cam wheel 9 opposite the crank 15 and the shaped blocking piece 16 of the detent pawl lever 5 extends to the opposite surface of the cam wheel 9 and interacts there with the blocking projection 17. The offset of the plane of the shaped blocking piece 16 relative to the actuating section of the detent pawl lever 5 on the bend of the angle arm which forms the shaped blocking piece 16 in FIG. 3 is clear.

Finally, the embodiment shown illustrates that the detent pawl lever 5 is pivotally mounted on the swivelling axis of the detent pawl 4 or the swivelling axis parallel to it. Support on the swivelling axis of the detent pawl 4 which is accomplished here leads to the detent pawl lever 5 with a driver arm 5' extending into another plane, specifically the plane of the detent pawl 4, or the detent pawl 4 with a corresponding arm or journal extending into the plane of the detent pawl lever 5. This is shown in FIG. 3. The support on the axis of the detent pawl 4 is kinematically suitable and uses the bearing bolt twice.

This embodiment moreover shows the supporting detent pawl 4 which blocks the rotary latch 3 and which is compressively stressed. The corresponding detent pawls which are tensile stressed, are made as a hook which extends over the rotary latch 3, can of course likewise be used in a corresponding modification of the detent pawl lever 5.

This preferred embodiment furthermore shows in FIG. 1 that the outside housing 1 on one flat side, and preferably on both flat sides, is provided with a metallic reinforcing plate 18, 19 or one each, that the metallic reinforcing plates 18, 19 are securely joined to one another, especially braced, with the interposition of the outside housing 1, and that the connection of the metallic reinforcing plates 18, 19 takes place via metallic bearing bolts 20 for the rotary latch 3 and the detent pawl 4.

Otherwise the outside housing 1 is held of course closed via other means, for example via catch clips, screws or a locking peripheral edge.

This preferred embodiment can implement all possibilities known in the prior art for contact-making of the drive motor 7 of the drive unit 6. According to one preferred teaching it can furthermore be provided that the electric drive motor 7 of the drive unit 6 makes contact directly on a circuit board or the like and has flexible contact strips which are securely attached to the contacts of the electrical drive motor 7 and which are soldered to the contact surfaces of the circuit board or the like.

The electric lock of the present invention is further advantageous due to its ease of installation. In fact it is possible, as FIG. 1 shows, to assemble the electric lock exclusively from one side so that rotation of the workpiece during installation is not necessary. This is a great simplification which has been rendered possible in construction terms by various measures.

This embodiment shows first of all that the outside housing 1 consists of a trough-shaped bottom 21 part made as a plastic molding and an essentially flat cover 22 which is likewise made as a plastic molding and which closes the bottom part 21 on the open side, that in the lowermost plane on the bottom of the bottom part 21 the rotary latch 3 and the detent pawl 4 are located, that in the lowermost plane of the bottom part 21, in addition to the rotary latch 3 and the detent pawl 4, the electrical drive unit 6 is located in the drive housing 11 and that in the second-lowermost plane, preferably supported on the same bearing bolt 20 as the detent pawl 4, the detent pawl lever 5 and a driven element 9 which is located on the outside of the drive housing 11, especially in the form of a cam wheel, are located.

It is furthermore provided that underneath the base of the bottom part 21 of the outside housing 1 there is a metal reinforcing plate 18, that bearing bolts 20 are securely attached to the metal reinforcing plate 18 and penetrate the through openings 23 in the bottom part 21 and in the cover 22, and that above the cover 22 there is another metal reinforcing plate 19 and the bearing bolts 20 are connected here to the second metal reinforcing plate 19. With this construction there is a sandwich-like arrangement of the outside housing 1 between the metal reinforcing plates 18, 19 so that an installation capacity of the electric lock is entirely independent of the side results. This construction makes it possible to undertake installation solely from one direction, especially beginning with the fact that the first reinforcing plate 19 is equipped from the start with bearing bolts 20 for the rotary latch 3 and the detent pawl 4 and is used to a certain extent as the "base plate" in the installation of the entire electric lock.

FIG. 1 also shows accordingly in this exploded view the process for installation of this electric lock which includes by the following process steps:

a) A first metal reinforcing plate 18 with bearing bolts 20 securely attached thereto for the rotary latch 3 and the detent pawl 4 with the bearing bolts 20 pointing upward is positioned on a base.

b) The trough-shaped bottom part 21 of the outside housing 1 made of a plastic molding is slipped onto the bearing bolts 20 by way of through openings 23 and pressed down as far as the reinforcing plate 18.

c) In the area of the inlet channel 2 the rotary latch 3 and the detent pawl 4 are inserted into the bottom part 21 and slipped onto the bearing bolts 20 with the bearing openings.

d) In addition to the rotary latch 3 and the detent pawl 4 a prefabricated drive housing 11 is inserted into the bottom part 21 and attached so that a driven element 9, in the form of a cam wheel, rests on the top of the drive housing 11.

e) The detent pawl lever 5 is slipped onto the bearing axle, onto the bearing bolt 20 of the detent pawl 4, and positioned such that it engages in operation the detent pawl 4 and the driven element 9.

f) A cover 22 which completes the inlet channel 2 and which closes the bottom part 21 of the outside housing 1 is seated on the bearing bolts 20 by means of the corresponding through openings and is joined to the bottom part 21.

g) A second metal reinforcing plate 19 is pressed onto the cover 22 and by way of the corresponding through openings onto the end of the bearing bolts 20 which project out of the cover 22.

h) The ends of the bearing bolts 20 are securely connected to the second metal reinforcing plate 19, by pressing or other means.

FIG. 1 shows for better recognition of the drive unit 6 the cover 13 of the drive housing 11 removed, although in the installation process described hereinabove the drive unit 6 is used as a modular unit.

In one modified process, when the drive unit 6 is fabricated on the assembly line it can be provided that instead of the process step d) the process steps are the following:

$d_1$) In addition to the rotary latch 3 and the detent pawl 4, the trough-shaped bottom part of the drive housing 11 which is open to the top and which is made especially as a plastic molding is inserted into the bottom part 21 of the outside housing 1, $d_2$) The electric drive motor 7 and step-down gearing 8 as well as other conventional parts are inserted into the bottom part of the drive housing 11, $d_3$) The bottom part of the drive housing 1 is closed by means of a cover 13 penetrated by the drive shaft 12 of the step-down gearing 8 in the rotary bushing, $d_4$) A driven element 9, particularly a cam wheel, is positioned on the projecting end of the drive shaft 12 and fixed thereto.

In another modified process, for an integrated drive housing 11 it can be provided that instead of the process step d) the following process steps d) are carried out:

$d_{1'}$) The components of the drive unit 6, therefore the drive motor 7 and the step-down gearing 8, are inserted into the trough-shaped bottom part of the drive housing 11, which bottom part is formed integrally in the outside housing 1 and positioned.

$d_{2'}$) The bottom part is sealed shut with a cover 13 which has a rotary bushing for the drive shaft 12 of the drive unit 6, drive shaft 12 being routed out sealed.

$d_{3'}$) A driven element 9, particularly a cam wheel, is positioned on the projecting end of the drive shaft 12 and fixed thereto.

While the present invention has been described with reference to a preferred embodiment, it should be appreciated by those skilled in the art that the invention may be practiced otherwise than as specifically described herein without departing from the spirit and scope of the invention. It is, therefore, to be understood that the spirit and scope of the invention be limited only by the appended claims.

What is claimed is:

1. A motor vehicle electric door lock, comprising an outside housing formed of a trough-shaped bottom part having an open side and an essentially flat cover which closes the open side of the bottom part, said outside housing being essentially closed on all sides and made as a plastic molding having an inlet channel for receiving a key collar, a detent pawl for holding the rotary latch, a separate detent pawl lever which is dynamically connected to the detent pawl or made as an extension thereof, and an electrical opening drive unit having a drive motor, a step-down gearing, and a driven element, the driven element via the detent pawl lever driving the detent pawl in a lifting direction engaging an actuating section of the detent pawl lever, further comprising a drive housing for housing the drive unit located in the outside housing and which is separate from and sealed relative to the outside housing, the driven element being a cam wheel which is positioned on the outside of the drive housing, and the drive shaft of the cam wheel which is routed through the wall of the drive housing, sealed by a rotary bushing, wherein the outside housing is made elongated and plate-shaped with two flat sides;

wherein the inlet channel with the rotary latch and the detent pawl is located substantially in a half of the outside housing near one lengthwise end and the drive unit is located substantially in a half of the outside housing near the other lengthwise end, and the detent pawl lever extends from one of said halves into the respective other half;

wherein the cam wheel is located on the outside of a wall of the drive housing parallel to a plane defined by the rotary latch and the detent pawl; and wherein the drive housing is a separate unit having a trough-shaped bottom part and a cover seated to form a seal about said drive housing, and is removably and replaceably inserted into a receiver of the trough-shaped bottom part of the outside housing.

2. The electric lock as claimed in claim 1, wherein the inlet channel is open towards the two flat sides of the outside housing.

3. The electric lock as claimed in claim 1, wherein the inlet channel is in the form of a catch bearing or as part of the catch bearing for the key collar.

4. The electric lock as claimed in claim 1, wherein the wall is formed by a cover which is seated on a trough-shaped bottom part of the drive housing to form a seal.

5. The electric lock as claimed in claim 1, wherein the cam wheel has an eccentrically arranged, arc-shaped crank which engages the actuating section of the detent pawl lever.

6. The electric lock as claimed in claim 1, wherein the drive unit actuates the detent pawl lever in only one direction of rotation of the cam wheel and the cam wheel in interaction with the actuating section carries out a degressive starting characteristic.

7. The electric lock as claimed in claim 1, wherein the drive unit actuates the detent pawl lever in both directions of rotation of the cam wheel and the cam wheel in one direction of rotation acts with a low step-down ratio on the detent pawl, conversely in the other direction of rotation with a larger step-down ratio on the detent pawl.

* * * * *